US006082413A

United States Patent [19]

Scorl et al.

[11] Patent Number: 6,082,413

[45] Date of Patent: Jul. 4, 2000

[54] WEFT STRETCHING AND DETECTING APPARATUS FOR A JET WEAVING LOOM

[75] Inventors: Hans-Dieter Scorl, Lindau; Ralf Koehnen, Cologne-Sulz, both of Germany

[73] Assignee: Lindauer Dornier Gesellschaft mbH, Lindau, Germany

[21] Appl. No.: 09/232,486

[22] Filed: Jan. 15, 1999

[30] Foreign Application Priority Data

Jan. 22, 1998 [DE] Germany ..... 198 02 254

[51] Int. Cl.[7] ..... D03D 47/30; D03D 51/34

[52] U.S. Cl. ..... 139/194; 139/370.2

[58] Field of Search ..... 139/194, 370.2

[56] References Cited

U.S. PATENT DOCUMENTS 5,226,458 7/1993 Bamelis .
5,606,998 3/1997 Wahhoud et al. .
5,735,316 4/1998 Hehle ..... 139/194

FOREIGN PATENT DOCUMENTS 0493847 7/1992 European Pat. Off. .
0645485 3/1995 European Pat. Off. .
WO 97/13017 4/1997 WIPO .

*Primary Examiner*—Andy Falik
*Attorney, Agent, or Firm*—W. F. Fasse; W. G. Fasse

[57] ABSTRACT

A weft stretching and detecting device for a pneumatic weaving loom has a housing or mounting (6) with a weft guide channel section (8) in axial alignment with the weft insertion channel (2A) in the reed (2) of the loom and a weft stretching channel section (12) also in said housing or mounting (6). A single weft stop motion device (13) is constructed and positioned for detecting a weft insertion fault either in the guide channel section (8) or in the stretching channel section (12).

12 Claims, 2 Drawing Sheets

13
13A
13C
3
16
15
13E
13B
6
18
13D
17
13C'
13B'
LOOM CONTROL
5

1
2
2A
3
4
2B
4A
4B 10
10A
12
9
9A
9B
A
8
7
11
14
II

WEFT STRETCHING AND DETECTING APPARATUS FOR A JET WEAVING LOOM

PRIORITY CLAIM

This application is based on and claims the priority under 35 U.S.C. § 119 of German Patent Application 198 02 254.9-26, filed in Germany on Jan. 22, 1998.

FIELD OF THE INVENTION

The invention relates to an apparatus for stretching and detecting weft threads as the weft threads exit from a weft insertion channel in the reed of a jet weaving loom with a pneumatic weft insertion.

BACKGROUND INFORMATION

German Patent Publication DE 4,443,371 C1 corresponding to U.S. Pat. No. 5,606,998 (Wahhoud et al.) discloses a weft detecting and stretching apparatus for a jet weaving loom, wherein the weft insertion channel in the reed can be lengthened or shortened at the exit end of the insertion channel by telescoping or extension sections forming one or more channel extension members. At least one weft stop motion device for sensing a weft thread extending out of the extension channel is provided for the extension channel. If two channel extensions are provided, one for weft guiding and one for weft stretching, then it is necessary according to U.S. Pat. No. 5,606,998 to provide a separate weft stop motion device for each of the two extension channels.

One of the channel extensions forming a weft guide is axially aligned with the weft insertion channel while the weft stretching channel extension preferably runs in parallel to the weft guide channel extension. Each channel extension is provided with its own weft stop motion device.

U.S. Pat. No. 5,226,458 (Bamelis) discloses a weft thread stretching mechanism or weft stretcher arranged at the exit end of the weft insertion channel through the reed. The weft stretcher and the reed are connected to the sley of the loom. The loom operates with a pneumatic weft insertion. The weft stretcher of Bamelis includes a weft thread guide channel positioned downstream of the weft thread exit area from the weft insertion channel in the reed as viewed in the weft insertion direction. The weft guide channel is aligned with the weft insertion channel in the reed. At the inlet of the stretching device, two openings are provided opposite one another. These openings form an exit of a first flow air channel and an inlet of a second air flow channel into which a weft thread leading end is diverted for the stretching by an airstream flowing out of the first flow channel into the second flow channel across the longitudinal central axis or plane of arrangement of the weft guide channel. The second stretching flow channel also forms a weft guide channel in the stretching device. Bamelis does not disclose any weft stop motion devices for his two channel extensions.

International Patent Publication WO 97/13017 (Bamelis et al.) discloses a weft stretching device attached to the exit end of the weft insertion channel in a reed. The stretching device has but one channel especially provided with weft diverting elements for guiding the weft thread along a weft stretching path. The weft diverting elements are positioned for stretching the weft thread, whereby a specially shaped single channel performs the functions of two channels. This International Publication WO 97/13017 does not disclose any weft stop motion devices.

The above described prior art leaves room for improvement. Where a single channel is equipped with weft guide elements, the consistent stretching of each weft thread is not always assured because the leading end of the weft thread being inserted may miss the critical guide element and thus stretching does not take place or at least proper stretching does not take place. On the other hand, where a guide channel and a stretching channel are arranged in parallel to each other at the exit end of the weft insertion channel in the reed, the space available for the positioning of the device may not be sufficient, especially if each channel is provided with its own weft stop motion device as is conventional.

OBJECTS OF THE INVENTION

In view of the foregoing it is the aim of the invention to achieve the following objects singly or in combination:

- to construct a weft stretching and detecting device with two individual channel sections for weft guiding and stretching, as a more compact arrangement compared to the prior art and so that both the guide channel section and the stretching channel section can be monitored with less effort and expense;
- to construct a weft stop motion device in such a way that a single device can monitor at least two separate weft channel sections; and
- to minimize or at least optimally reduce the axial on-center spacing between the guide and stretching channel sections.

SUMMARY OF THE INVENTION

The above objects have been achieved by positioning a single weft stop motion device relative to both the weft guide and weft stretching channel sections in such a way that the single weft stop motion device can detect the weft thread when it passes through the guide channel section in alignment with the insertion channel or when the weft thread passes through the stretching channel section. In other words, detection of a faulty weft insertion is assured in any one of these channel sections even with only a single weft stop motion device.

The two channel sections are preferably arranged in parallel to each other in respective mounting planes in a housing or support. Each channel section has a central longitudinal axis extending in the respective mounting plane. The on-center spacing between these two axes is optimally reduced or minimized by leaving just sufficient space for positioning the single weft stop motion device while simultaneously assuring the required weft stretching. The weft stop motion device comprises a radiation transmitter and a radiation receiver so positioned relative to each other that both channel sections are monitored simultaneously. A medium passing a radiation flow is arranged between the receiver and the transmitter. Such radiation passing medium may be an air space forming a weft detection passage at the end of the respective channel section through which the weft travels or through which the weft does not travel when a fault occurs. The radiation passing medium may be an air space or a light conductor between the channel sections.

Either the receiver or the transmitter may have two sections. If the receiver has two sections, both receiver sections are so positioned across the respective detection passage that both receiver sections cooperate with a single transmitter located between the detection passages. If the transmitter has two sections, both transmitter sections are so positioned across the respective detection passage that both transmitter sections cooperate with a single receiver located between the detection passages.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figures 1, 2:
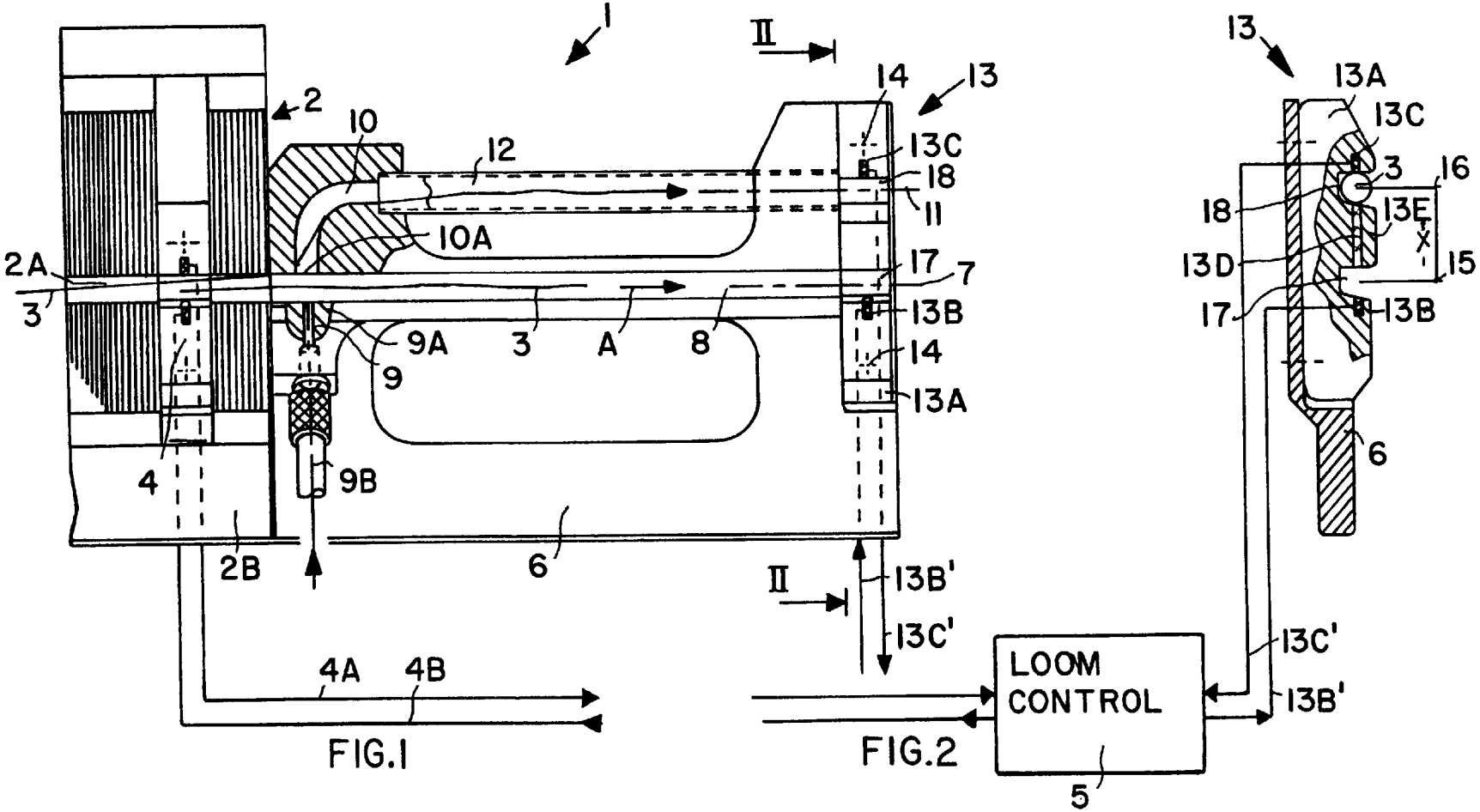
FIG. 1 shows a front view of the weft exit side of a reed with which the present weft stretching and detecting device cooperates, a radiation receiver and a radiation transmitter are positioned for cooperating with two channel sections of the weft stretching and detecting device.
FIG. 2 is a sectional view along section line II—II in FIG. 1 showing how one transmitter and one receiver can detect faulty weft insertions in each of the two channel sections.

FIG. 1 shows the present weft stretching and detecting apparatus or device 1 secured at an exit end of a reed 2 of a weaving loom. The reed 2 has a weft insertion channel 2A through which a weft thread 3 is inserted by pneumatic nozzles not shown. The reed 2 is secured to a sley 2B. The device 1 may be secured to the sley 2B by conventional attachment elements such as screws, not shown. A weft stop motion device 4 is positioned at the exit end of the reed but upstream of the selvage forming portion of the reed as viewed in the feed advance direction A of the weft insertion.

The conventional weft stop motion device 4 may comprise, for example an electro-optical sensor including a light source and a light sensing element connected through electrical conductors 4A and 4B to a central loom control 5. The weft stop motion device 4 monitors the proper insertion of the weft threads into the loom shed. If the weft stop motion device 4 determines that a weft thread is too short, the respective signals will be transmitted to the loom control 5 which in turn stops the weaving operation as is conventional.

The weft stretching and detecting device 1 according to the invention comprises a housing or mounting 6 secured to the sley 2B. First and second weft channel sections 8 and 12 are provided in or on the housing or mounting 6. The channel section 8 forms a weft guide having a central axis or central mounting plane 7 axially aligned with the central longitudinal axis of the weft insertion channel 2A of the reed 2. The cross-sectional configuration of the weft guide channel section 8 and its cross-sectional size are preferably substantially identical to the respective cross-section and size of the weft insertion channel 2A in the reed 2.

The channel section 12 forms a weft stretching channel that receives a stretching air flow through an air guide duct 10 in the housing or mounting 6. The air guide duct 10 has an inlet 10A facing an air outlet 9A of a further air duct 9 connected to an air supply hose 9B. The air outlet 9A is arranged across the weft guide channel section 8 opposite the inlet 10A. Thus, an airstream passing through the exit 9A out of the air duct 9 crosses the weft guide channel section 8, thereby entraining the leading end of a weft thread 3 and pulling the weft thread 3 into the weft stretching channel section 12. The airstream through the air supply hose 9B is conventionally controlled by the central loom control 5. As the leading end of the weft thread 3 passes through the air guide duct 10 into the stretching channel 12, the weft thread 3 is stretched as required.

The cross-sectional configuration and size of the channel section 12 is substantially the same as the above-mentioned configuration and size of the channel section 8 and of the channel 2A. "Substantially" in this and the above context means that a cross-section with, for example, rounded corners is substantially identical with a cross-section having square corners. Any cross-sectional channel sizes that permit the proper passing of the weft thread are considered to be substantially identical to each other.

According to the invention, both channel sections 8 and 9 are monitored by a single weft stop motion device 13. The device 13 is secured to the housing 6 by conventional elements such as screws 14 merely shown symbolically.

The weft stop motion device 13 according to the invention comprises a support or carrier 13A. A radiation transmitter 13B, such as a light source, is positioned opposite a radiation receiver 13C, such as a light sensor with sensor passages 17 and 18 positioned between the transmitter and receiver. A radiation passing element 13D is positioned in an intermediate section 13E of the carrier 13A between the two detection passages 17 and 18. The detection passage 17 forms an extension of the weft guide channel section 8 and is axially aligned with the section 8. The detection passage 18 forms an extension of the channel section 12 and is axially aligned with the channel section 12. Thus the central axes or position planes 15 and 16 of the detecting passages 17 and 18, respectively, are aligned with the respective central axes 7 and 11 as is apparent from viewing FIGS. 1 and 2 in conjunction. When radiation passes from the transmitter 13B through the detection passage 17, then through the radiation passing element 13D, then through the detection passage 18 to the receiver or sensor 13C it is possible to monitor both passages 17 and 18 with a single weft stop motion device 13.

FIG. 2 shows the position of the transmitter 13B peripherally outside the detection passage 17 on one side thereof. The receiver 13C is similarly positioned at the periphery of the detection passage 18, however on the opposite side so that radiation must pass through both passages 17 and 18. Thus, a faulty weft insertion is detected in either of the passages 17 and 18. Such detection may, for example, be caused by the interruption of a light beam, either in the passage 17 or in the passage 18. In FIG. 2 the radiation passing medium 13D is a light conductor. The transmitter 13B is connected through an electrical conductor 13B' to the loom control 5. The receiver or sensor 13C is connected through an electrical conductor 13C' to the loom control 5. The loom control 5 causes the transmitter 13B to transmit a detecting signal in response to a control signal through the conductor 13B'. A sensed signal received from the sensor 13C through the conductor 13C' is processed in the loom control 5 for generating a loom stopping control signal as is conventional.

Figure 3:
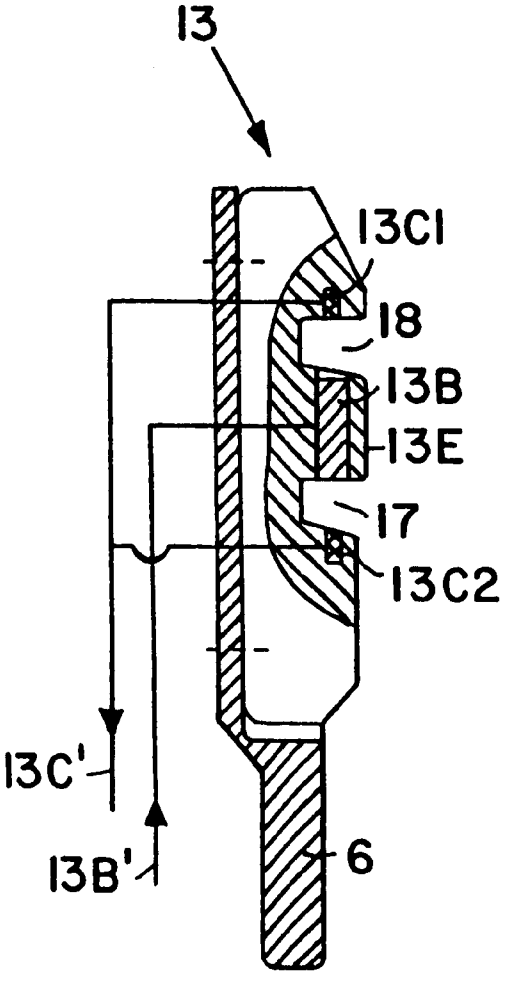
FIG. 3 is a sectional view similar to FIG. 2 showing one transmitter positioned for cooperation with two receiver sections located on opposite sides of the transmitter at an outer periphery of a respective detection passage.

FIG. 3 illustrates an embodiment in which the radiation transmitter 13B is mounted in the intermediate section 13E and emits radiation in both directions upwardly through the detector passage 18 and downwardly through the detector passage 17. The receiver is provided with a first section 13C1 positioned peripherally relative to the detection passage 18 and a second receiver section 13C2 positioned peripherally to the passage 17 so that radiation from the transmitter 13B can be interrupted in either the passage 17 or 18 for generating the respective control signal.

Figure 4:
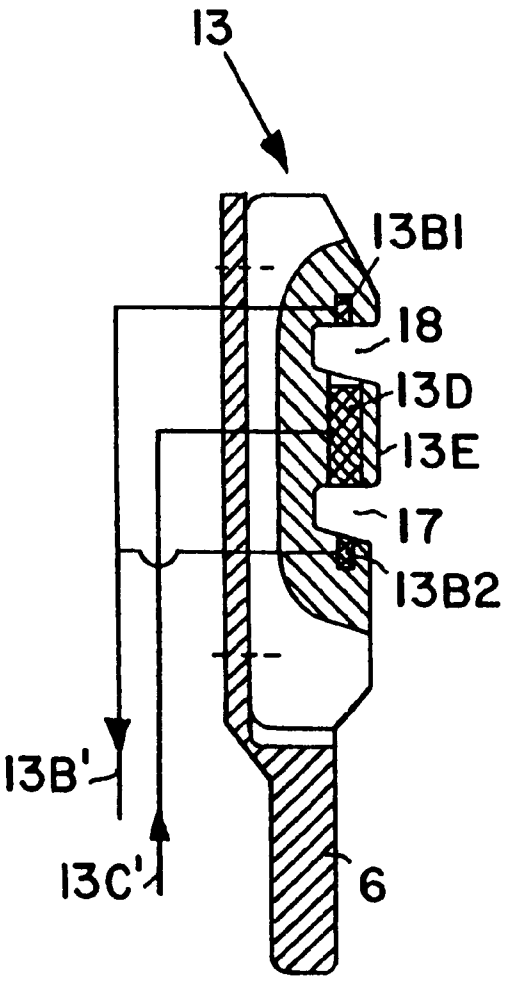
FIG. 4 is a sectional view similar to FIG. 2 showing one receiver positioned for cooperation with two transmitter sections located on opposite sides of the receiver at an outer periphery of the respective detection passage.

FIG. 4 illustrates an embodiment, wherein the transmitter has two sections 13B1 and 13B2. The transmitter section 13B1 is positioned peripherally relative to the passage 18 opposite one receiver end. The transmitter section 13B2 is positioned peripherally relative to the passage 17 opposite the other end of the receiver 13C positioned or located between the detection passages 17 and 18 in the intermediate carrier section 13E. Thus again the same operation is assured as in the other embodiments, namely the detection of faults in both passages 17 and 18 by a single stop motion device 13.

Figure 5:
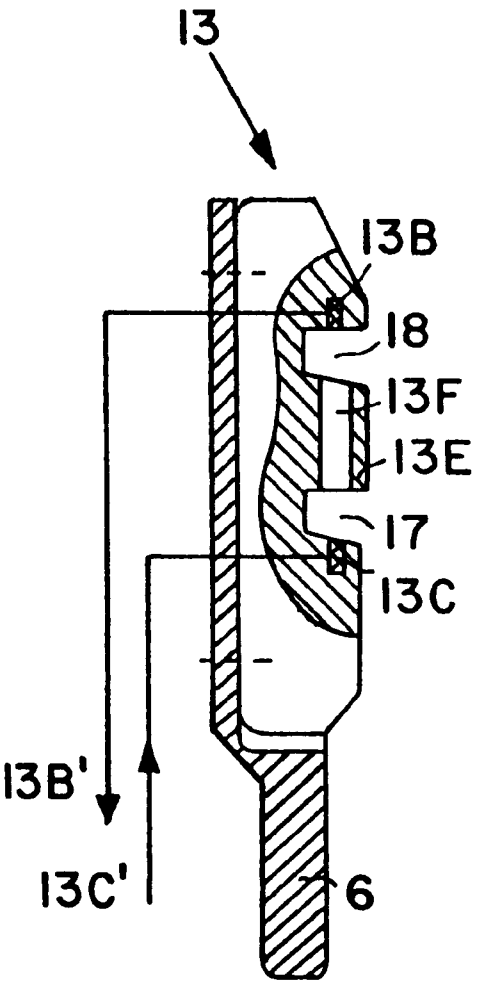
FIG. 5 is a sectional view similar to FIG. 2 showing one receiver in the position of the transmitter in FIG. 2 and one transmitter in the position of the transmitter in FIG. 2 with an open air transmission path between the two detection passages.

FIG. 5 illustrates an embodiment similar to that of FIG. 2, however the position of the transmitter and receiver has been reversed in FIG. 5 compared to FIG. 2. Thus, the transmitter 13B is positioned peripherally above the passage 18 while the receiver 13C is positioned peripherally below the passage 17. The intermediate section 13E between the detection passages 17 and 18 has a throughbore 13F through which, for example light can pass to be received by the receiver 13B or interrupted by a faulty weft insertion.

By providing but one weft stop motion device 13 for at least two channel sections, the entire structure can be more compact compared to the prior art which require one weft stop motion device for each channel. Additionally a more cost efficient structure is achieved due to using but one weft stop motion device for monitoring at least two channels.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A weft stretching and detecting apparatus for a jet weaving loom having a reed (2) with a weft insertion channel (2A), said apparatus comprising a housing (6) for attachment to said jet weaving loom, a first weft guiding channel section (8) in said housing (6) in axial alignment with said weft insertion channel (2A) in said reed (2), a second weft stretching channel section (12) in said housing (6), an air flow passage positioned for stretching a weft thread in said second weft stretching channel section (12), a single weft stop motion device (13) comprising a carrier (13A) secured to a weft exit end of said housing (6), and an electro-optical detector (13B, 13C) mounted to said carrier (13A) and positioned for detecting a weft insertion fault in any one of said first and second channel sections (8, 12), and wherein said carrier (13A) comprises a first weft detection passage (17) in an axial alignment with said first weft guide channel section (8), and a second weft detection passage (18) in axial alignment with said second weft stretching channel section (12).

2. The apparatus of claim 1, wherein said first weft guide channel section (8) has a first central axis (7), wherein said second weft stretching channel section (12) has a second central axis (11), said first central axis (7) extending in a first central plane (15) passing through said first weft detection passage (17), said second central axis (11) extending in a second central plane (16) passing through said second weft detection passage (18), said first and second central axes (7, 11) extending in parallel to each other, whereby said first and second central planes (15, 16) also extend in parallel to each other.

3. The apparatus of claim 1, wherein said first weft guide channel section (8), said second weft stretching channel section (12), said first weft detection passage (17) and said second weft detection passage (18) have substantially the same cross-sectional configuration and cross-sectional size.

4. The apparatus of claim 1, wherein said electro-optical detector (13B, 13C) of said weft stop motion device (13) comprises a radiation transmitter (13B), a radiation receiver (13C) and a radiation passing medium (13D, 13F) positioned in said carrier (13A) between said radiation transmitter and said radiation receiver.

5. The apparatus of claim 4, wherein said carrier (13A) comprises an intermediate section (13E) between said first and second weft detection passages (17, 18) and wherein said radiation passing medium (13D, 13F) is contained in said intermediate section (13E).

6. The apparatus of claim 5, wherein said radiation transmitter (13B) is located peripherally next to one of said first and second detection passages (17, 18), wherein said radiation receiver (13C) is located peripherally next to the other of said first and second detection passages (17, 18) opposite said radiation transmitter so that radiation passing through said medium (13D, 13F) and through said detection passages (17, 18) is interruptible by a faulty weft insertion.

7. The apparatus of claim 5, wherein said intermediate section (13E) comprises a throughbore, wherein said radiation passing medium (13F) is air in said throughbore, and wherein said radiation transmitter (13B) is located peripherally next to one of said first and second detection passages (17, 18), wherein said radiation receiver (13C) is located peripherally next to the other of said first and second detection passages (17, 18) opposite said radiation transmitter (13B) so that radiation passing through said medium and through said detection passages (17, 18) is interruptible by a faulty weft insertion.

8. The apparatus of claim 4, wherein said carrier (13A) comprises an intermediate section (13E) between said first and second weft detection passages (17, 18), and wherein said radiation transmitter (13B) is located in said intermediate section (13E), said radiation receiver (13C) comprising a first receiver section (13C1) and a second receiver section (13C2), wherein said first receiver section (13C1) is located peripherally next to one of said first and second detection passages (17 or 18) opposite said radiation transmitter (13B), and wherein said second receiver section (13C2) is located peripherally next to the other of said first and second detection passages (17 or 18) also opposite said radiation transmitter (13B), whereby said radiation transmitter (13B) cooperates with said first receiver section (13C1) and with said second receiver section (13C2) across said first and second weft detection passages (17, 18), respectively.

9. The apparatus of claim 4, wherein said carrier (13A) comprises an intermediate section (13E) between said first and second weft detection passages (17, 18), and wherein said radiation receiver (13C) is located in said intermediate section (13E), said radiation transmitter (13B) comprising a first transmitter section (13B1) and a second transmitter section (13B2), wherein said first transmitter section (13B1) is located peripherally next to one of said first and second detection passages (17, 18) opposite said radiation receiver (13C), and wherein said second transmitter section (13B2) is located peripherally next to the other of said first and second detection passages (17, 18) also opposite to said radiation receiver (13C), whereby said radiation receiver (13C) cooperates with said first transmitter section (13B1) and with said second transmitter section (13B2) across said first and second weft detection passages (17, 18) respectively. (FIG. 4).

10. The apparatus of claim 4, wherein said radiation transmitter (13B) is a light source and wherein said radiation receiver (13C) is a light sensor.

11. The apparatus of claim 10, wherein said radiation passing medium is a light conductor (13D).

12. The apparatus of claim 4, further comprising a control (5) and electrical conductors (13B', 13C') connecting said radiation transmitter (13B) and said radiation receiver (13C) to said control for feeding signals to said transmitter and for receiving sensed signals from said receiver to generate control signals for said loom.

* * * * *